US005241953A

United States Patent [19]

Sykes

[11] Patent Number: 5,241,953

[45] Date of Patent: Sep. 7, 1993

[54] FLUID PRESSURE MASSAGE SYSTEM

[76] Inventor: Jerrold Sykes, 1405 Aster Dr., Antioch, Calif. 04509

[21] Appl. No.: 882,619

[22] Filed: May 13, 1992

[51] Int. Cl.[5] ..... A61H 9/00

[52] U.S. Cl. ..... 128/66

[58] Field of Search ..... 128/66, 65, 24 R

[56] References Cited

U.S. PATENT DOCUMENTS

| | | | |
|---|---|---|---|
| 1,715,043 | 5/1929 | Oye | 128/66 |
| 3,088,459 | 5/1963 | Rabinoff . | |
| 3,283,756 | 11/1966 | Turley | 128/66 |
| 3,478,738 | 11/1969 | Altman et al. . | |
| 3,741,201 | 6/1973 | Oudkerk . | |
| 3,757,806 | 9/1973 | Bhaskar et al. . | |
| 3,837,334 | 9/1974 | Johnson | 128/66 |
| 3,918,987 | 11/1975 | Kopfer . | |
| 3,939,825 | 2/1976 | Krummenacher | 128/66 |
| 4,090,507 | 5/1978 | Van Horn | 128/66 |
| 4,099,522 | 7/1978 | Alenares | 128/66 |
| 4,353,359 | 10/1982 | Milbauer . | |
| 4,465,522 | 8/1984 | Taldo | 128/66 |
| 4,620,529 | 11/1986 | Kurosawa . | |
| 4,670,010 | 6/1987 | Dragone . | |

FOREIGN PATENT DOCUMENTS

| | | | |
|---|---|---|---|
| 8300645 | 3/1983 | World Int. Prop. O. | 128/66 |

*Primary Examiner*—Robert A. Hafer
*Assistant Examiner*—David J. Kenealy
*Attorney, Agent, or Firm*—Thomas R. Lampe

[57] ABSTRACT

Apparatus for applying fluid pressure at spaced, predetermined locations on a foot or hand including a cabinet of multi-wall construction having an interior for accommodating the hand or foot. A plenum formed by the walls of the cabinet is pressurized with a fluid to direct the fluid into contact with the hand or foot. Suitable structure is provided to position the hand or foot at a predetermined location within the interior spaced from the apertures.

13 Claims, 8 Drawing Sheets

FLUID PRESSURE MASSAGE SYSTEM

TECHNICAL FIELD

This invention relates to a fluid pressure massage system. More particularly, the invention is directed to apparatus for applying fluid pressure at predetermined, spaced locations on at least one human extremity.

BACKGROUND ART

Many prior art techniques and systems are known for massaging the human hand and foot. Most typically, such massage is accomplished through direct engagement and manipulation by fingers. It is also known to use tools or implements to accomplish the massage. The massage can be of a rather general nature wherein the hand or foot is worked over its entirety or of a more specialized nature wherein certain established points or locations on the hand or foot have pressure applied thereto for therapeutic effect.

Exemplary or this of this latter type of specialized massage is that incorporating the teachings of reflexology wherein reflex points or locations on hands and feet are identified and pressure applied thereto by direct manual massage or by manipulated hand-held tools.

It is, of course, well known to immerse human extremities in whirl pool baths or the like wherein the entire extremity is engaged by rapidly moving water or other liquid. By their very nature, such systems do not selectively apply pressure at specific locations on a hand or foot. Thus, the therapeutic effect of prior art apparatus employing the immersion principle is somewhat limited. Generally representative of immersion type systems is the foot bath disclosed in U.S. Pat. No. 4,620,529, issued Nov. 4, 1986.

Lavage or scrubbing systems, often designated for use by surgeons or other medical professionals, are also known in the prior art. Exemplary of these are the devices shown in U.S. Pat. No. 3,757,806, issued Sep. 11, 1973 and U.S. Pat. No. 3,918,987, issued Nov. 11, 1975. While such arrangements employ water jets to apply liquid to an extremity, they are, in effect, immersion systems wherein the extremity is randomly positioned relative to the jets and pressure is not applied to any particular locations on the extremity. It is the object of these prior art devices to completely wash or immerse the extremity for scrubbing purposes. There is no provision for directing discrete jets at particular locations on the extremity, which is highly desirable, for example, when practicing reflexology or related therapeutic techniques.

U.S. Pat. No. 3,741,201, issued Jun. 26, 1973, discloses foot care apparatus wherein feet may be massaged, simultaneously cleaned, and treated with a disinfecting or medicinal substance. Spray nozzles are utilized to direct a liquid against the foot, but fluid application is essentially random, with no attempt being made to direct the jets to particular locations on the foot. By contrast, the present invention provides for the specific placement of an extremity relative to jet apertures formed in the walls of the apparatus cabinet structure. Utilization of the cabinet walls to define the apertures as well as the particular extremity positioning means employed in the present system allows for more accurate impingement of the jet streams and assures that the desired areas of the entire extremity can be impacted and treated.

A search of the prior art also located the following patents, which are of general interest: U.S. Pat. No. 4,670,010, issued Jun. 2, 1987, U.S. Pat. No. 4,353,359, issued Oct. 12, 1982, U.S. Pat. No. 3,478,738, issued Nov. 18, 1969, and U.S. Pat. No. 3,088,459, issued May 7, 1963.

DISCLOSURE OF INVENTION

The present invention relates to apparatus for applying fluid pressure, such as liquid or gaseous pressure, at spaced locations on at least one human extremity. The apparatus includes cabinet means defining an interior for receiving at least one human extremity. The cabinet means is of multi-walled construction with the walls defining a plenum and a plurality of apertures providing fluid-flow communication between the plenum and the interior.

Pressurized fluid supply means supplies pressurized fluid to the plenum whereby the pressurized fluid will exit from at least some of the apertures and be directed in the form of discrete jets into the interior.

Positioning means is in operative association with the cabinet means and engageable by the at least one human extremity to position same at a predetermined location within the interior spaced from the apertures whereby jets will be directed at predetermined, spaced locations on the human extremity.

The plenum comprises a plurality of plenum chambers. The apparatus additionally comprises means operatively associated with the cabinet means and the pressurized fluid supply means to direct the pressurized fluid to preselected plenum chambers.

The cabinet means comprises separate first and second cabinet modules. One of the cabinet modules is for accommodating at least one human foot and the other of the cabinet modules is for accommodating at least one human hand. Connector means is provided for selectively alternatively operatively connecting the pressurized fluid supply means, which itself is in modular form, to the cabinet modules.

The cabinet means includes side walls and a divider wall positioned between the side walls. The side walls and the divider wall each include a pair of spaced wall panels. At least some of the wall panels define the apertures. The divider wall divides the interior into two separate interior portions, each of the interior portions sized to accommodate a human extremity.

Both of the wall panels of the divider wall define apertures for directing fluid jets toward an opposed wall side. The wall panels of the side walls comprise an inner panel and an outer panel. The outer panels are fluid impermeable and the inner panels define apertures for directing fluid jets toward the divider wall.

Other features, advantages, and objects of the present invention will become apparent with reference to the following description and accompanying drawings.

BEST MODE FOR CARRYING OUT THE INVENTION

Figure 1:
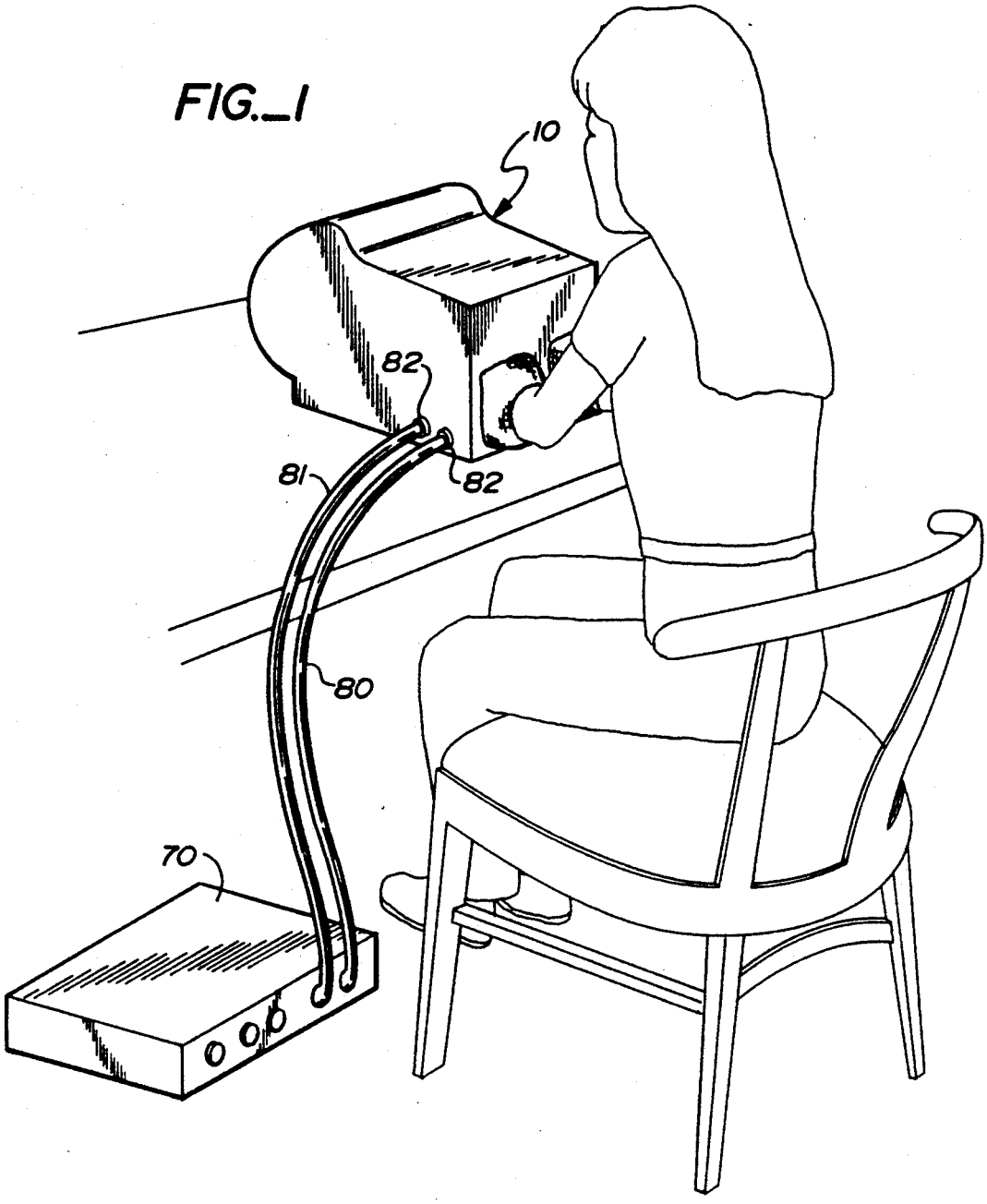
FIG. 1 is a perspective view of apparatus constructed in accordance with the teachings of the present invention being employed by a person to massage her hands.
Figure 2:
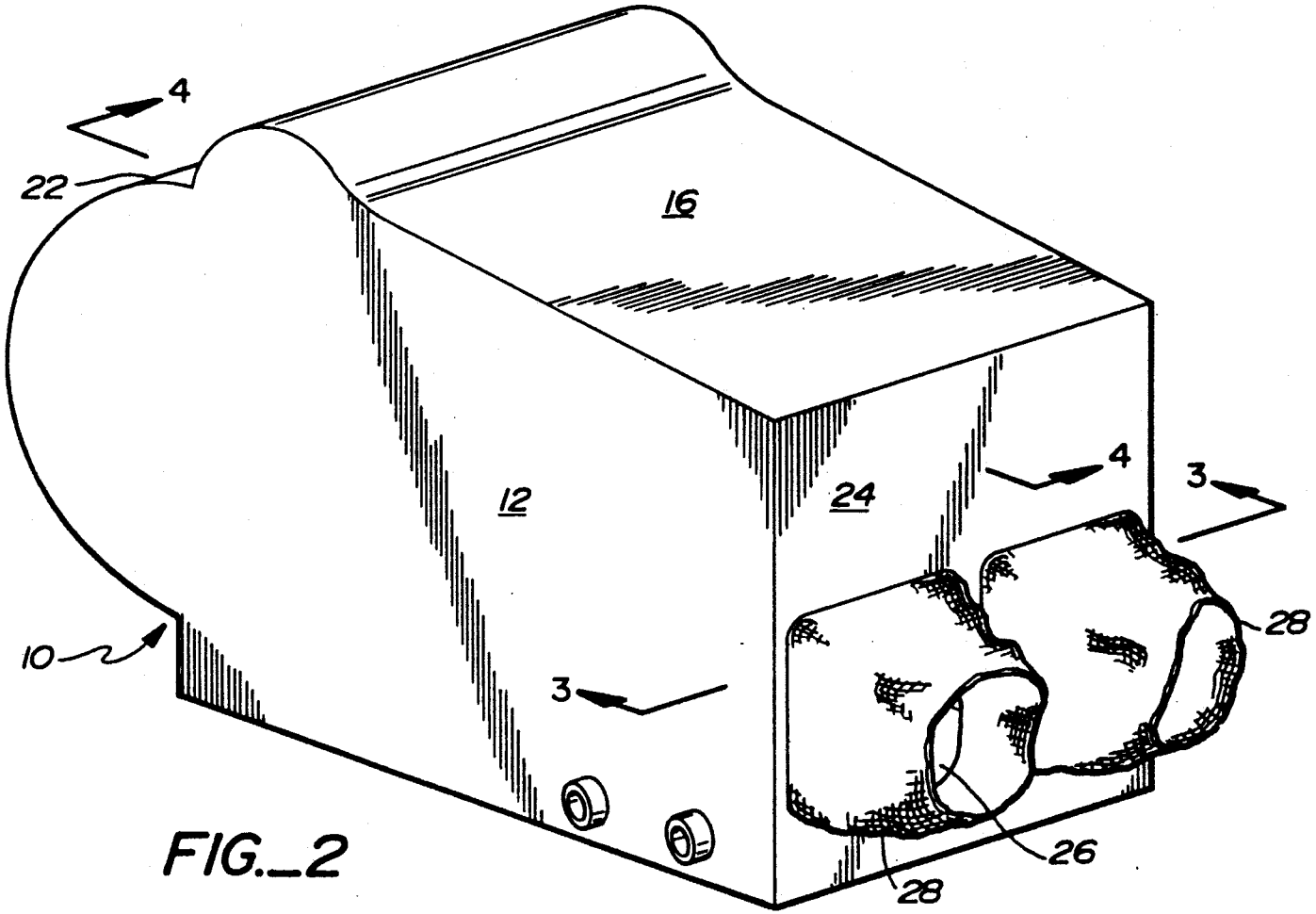
FIG. 2 is an enlarged, frontal, perspective view of a cabinet module employed in the apparatus.

Referring now to FIGS. 1–4, apparatus constructed in accordance with the teachings of the present invention includes a cabinet 10. Cabinet 10 incorporates side walls 12, 14, a top wall 16, and a bottom 18. A sump 20 is located under the bottom. The cabinet 10 also includes a front wall 22 and a back wall 24. The back wall 24 defines two openings 26 disposed side-by-side which are surrounded by sleeves 28 formed of fabric or other suitable flexible material. The openings 26 allow the user of the apparatus to insert his or her hands and forearms into the interior of the cabinet.

Side walls 14 each include an inner panel 30 and an outer panel 32 defining a space therebetween. The inner panels 30 define a plurality of apertures leading from such space to the interior of the cabinet. These apertures are located at predetermined locations in the inner panels. These locations are so positioned as to be in general alignment with the hand of a user when the hand is properly positioned within the cabinet as shown, for example, in FIG. 4. That is, the apertures 34 are so located as to direct jets of fluid against specific predetermined locations of the hand during operation of the device, as will be explained in greater detail below.

Figure 3:
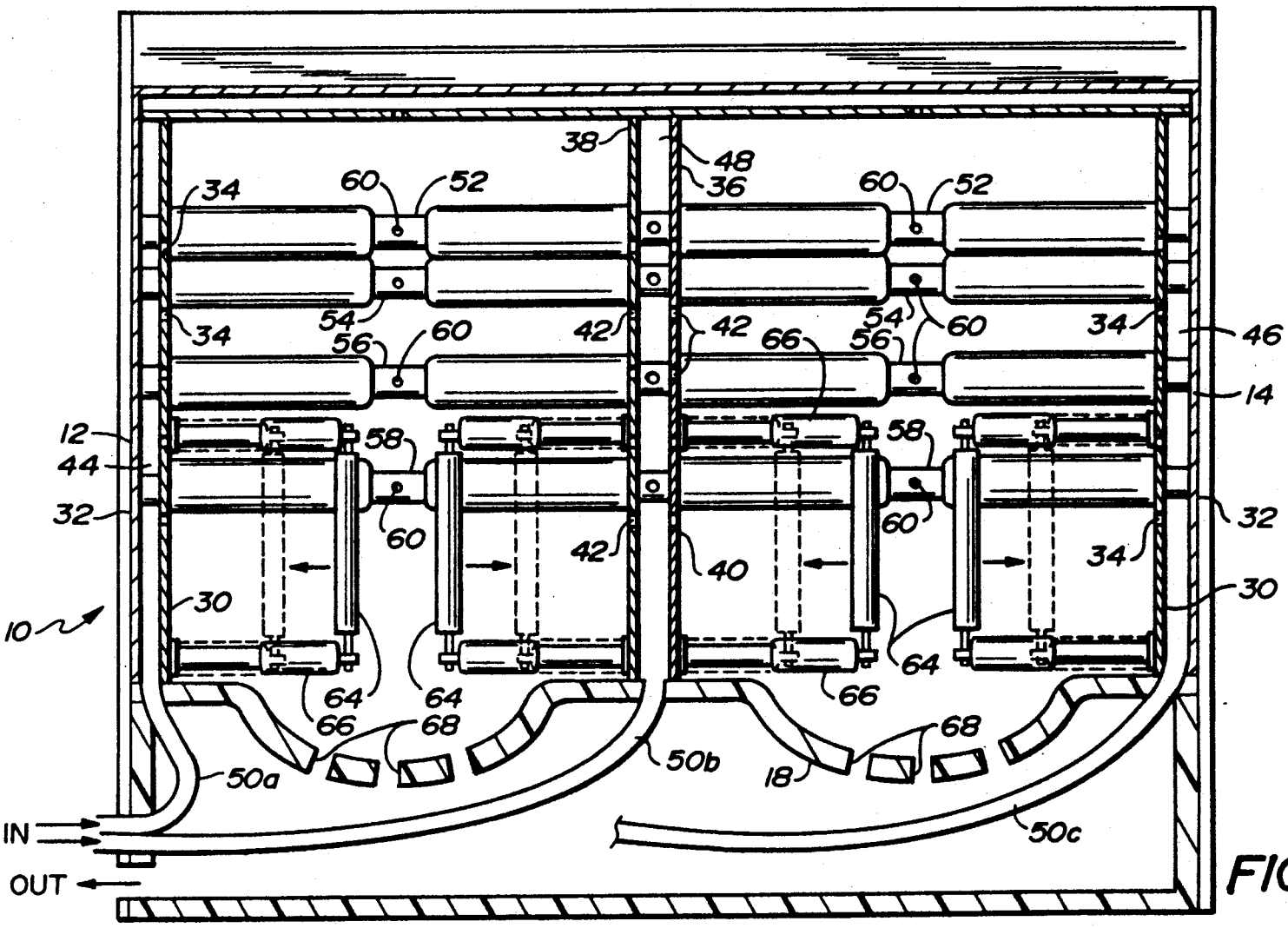
FIG. 3 is an enlarged, cross-sectional view taken along the line 3—3 in FIG. 2.
Figure 4:
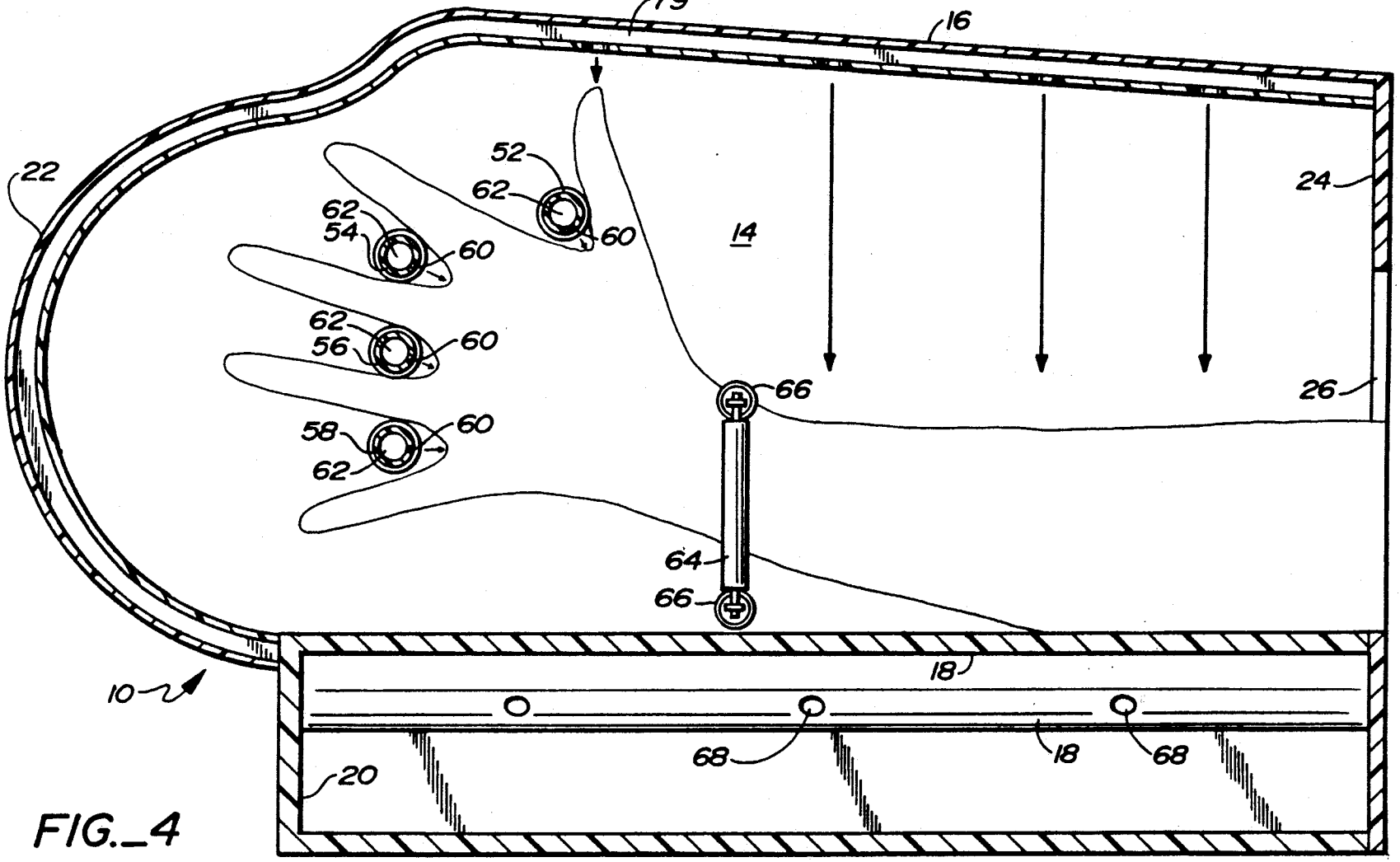
FIG. 4 is an enlarged, cross-sectional view taken along the line 4—4 of FIG. 2.

Cabinet 10 also includes a divider wall 36 positioned between the side walls. The divider wall 36 divides the interior into two separate interior portions, each of which is sized to accommodate a human hand and forearm as shown in FIG. 4. As was the case with respect to the side walls, the divider wall includes two spaced divider wall panels 38, 40 defining a space therebetween (see FIG. 3). Apertures 42 are formed in the wall panels 38, 40 at spaced, predetermined locations therein which correspond with predetermined locations of a hand positioned as shown in FIG. 4.

The spaces defined by the side wall panels 30, 32 and by the divider wall panels 38, 40 define a plenum into which pressurized fluid is to be introduced. The plenum is actually separated into three discrete and distinct plenum chambers, plenum chamber 44 in side wall 12, plenum chamber 46 in side wall 14, and plenum chamber 48 formed in divider wall 36. During operation of the apparatus, pressurized fluid is injected into the plenum chambers on a selective basis through hoses or tubing communicating therewith. This may best be seen with reference to FIG. 3 wherein the tubing communicating with the plenum chambers shown in that Figure are, from left to right, tubing members 50*a*, 50*b*, and 50*c*, the tubing passing through the sump portion of the apparatus disposed below bottom 18. Such an arrangement enables the plenum chambers to be pressurized separately and independently of the others. That is, the apparatus is so constructed as to enable either or both sides of the hands positioned in the cabinet to be impacted by pressurized fluid.

Positioning means is provided to properly and correction position the hand or hands of a user within the cabinet interior so that the hand or hands are in alignment with the proper apertures formed in the walls of the cabinet communicating with the interior. The positioning means includes four conduits 52, 54, 56, 58 which extend between the side walls and divider wall as shown in FIG. 3.

The conduits may be formed, as shown, so that the center or middle thereof is somewhat recessed to accommodate the splayed fingers of the user. Each of the conduits has at least one aperture 60 formed therein which is directed toward the hand. Apertures 60 are in communication with passageways 62 defined by the conduits. These passageways are in communication with plenum chamber 48 of the divider wall through openings formed in the conduits. Thus, pressurization of the plenum chamber 48 will also pressurize passageway 62, and cause a jet of fluid to exit through each aperture 60 as indicated by the arrows in FIG. 4 so that the jet will engage the user's hand at the junction of his or her fingers.

Additional positioning of the hand and forearm is accomplished by guides or spacers 64 in the form of rollers which are disposed at the ends of telescoping members 66 secured to the side walls. Biasing means, such as a coil spring (not shown) is disposed within each telescoping member to continually urge the distal ends thereof away from the side walls, i.e., to the solid lined position illustrated in FIG. 3. A person inserting his or her hand between the spacers 64 can overcome the biasing force and move same in the directions indicated by the arrows in FIG. 3. The opposed forces exerted by the spacers or rollers 64 will urge the user's hand toward the center of the interior portion so that the hand will be properly aligned and positioned to engage the centers of the conduits 52–58. Alternatively, the spacers may be fixed in position relative to the side and divider walls.

Means is employed for providing pressurized fluid to the plenum of cabinet 10 through tubing members 50*a*, 50*b*, 50*c*. A separate module 70 is in communication with the tubing members and is located at a position removed from that occupied by the cabinet 10.

Figure 10:
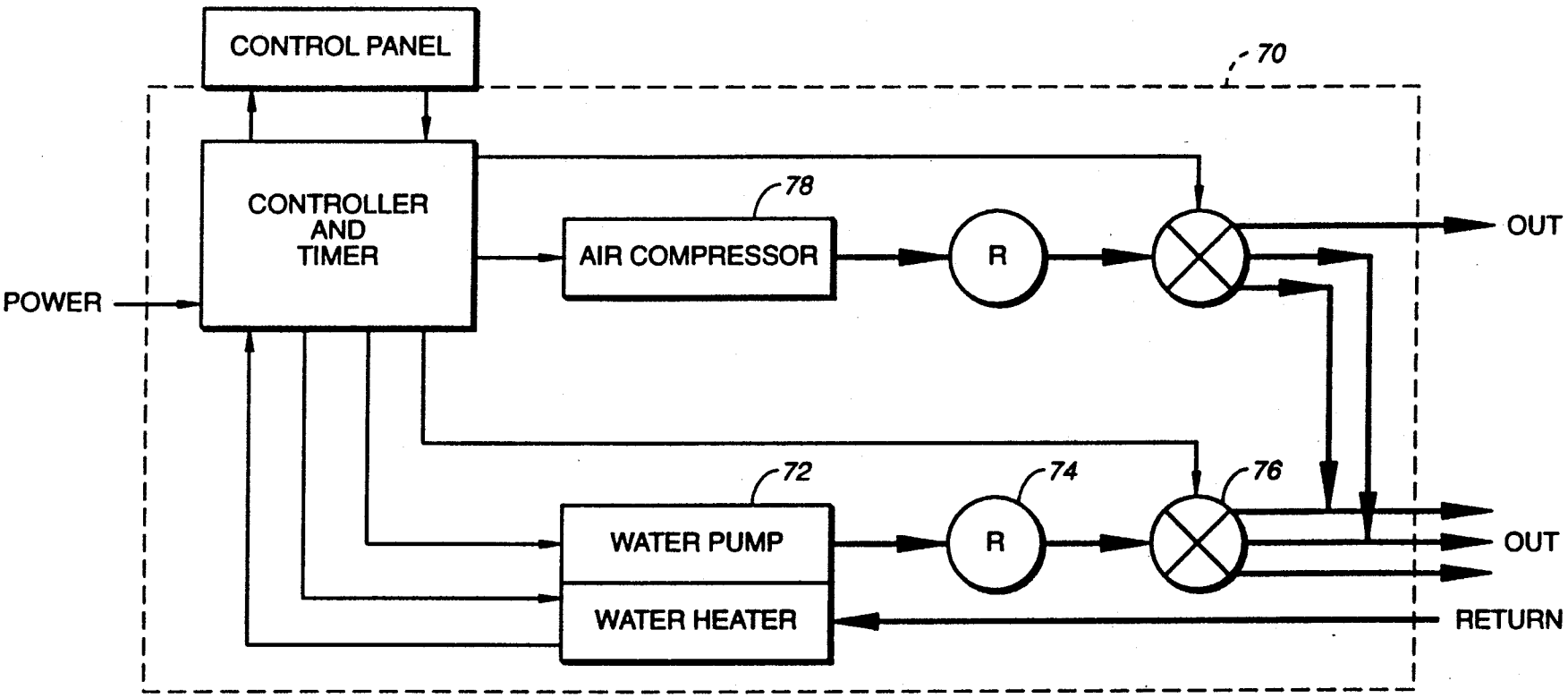
FIG. 10 is a schematic presentation illustrating diagrammatically the components of a pressurized fluid supply module incorporated in the apparatus.

FIG. 10 illustrates in schematic fashion the primary components of module 70. A control panel including knobs projecting from the module housing controls the operation of the apparatus. Among the components is a water pump 72 which pumps water or other liquid through a regulator 74 and a valve 76 to selected tubular members, the operator selecting the number and identity of the plenum chambers to be pressurized The water or other liquid will enter the interior of the cabinet through the aforedescribed apertures in the side and divider walls to impinge upon the user's hands at the desired locations thereon. For example, when practicing reflexology, the reflex points which are well known to persons skilled in the art will have apertures aligned therewith and a jet spray impinged thereupon. Excess water will enter the apparatus sump through drains 68 in the bottom 18. The drained water or other liquid will flow out though an exit opening communicating with the sump by the vacuum created by water pump 72. Preferably, the drained liquid will pass through a water heater operatively associated with the water pump prior to being recirculated back through the pump and to the cabinet 10. A suitable controller and timer device may be utilized to control the length and timing of the operation of the liquid pump 72.

Rather than utilize a liquid as the fluid, air or other gas may be pressurized and utilized. FIG. 10 illustrates the fact that module 70 also houses a suitable air compressor arrangement 78 for accomplishing this. Likewise, a combination of gas and liquid may be selected as the fluid to be applied to the preselected locations of the user's hand.

In the arrangement illustrated, a space is also defined by the front wall 22 and top wall 16. If desired, such space, space 79, may be placed into communication with the outlet of air compressor 78 to provide for drying of the user's hand by compressed air flowing through orifices formed in the top wall and/or front wall as indicated by the arrows in FIG. 4. The aforedescribed sleeves 28, while discouraging outward flow of fluid from the interior of the cabinet, will provide for the ready ingress and egress of the user's hands with respect to the cabinet.

Figure 5:
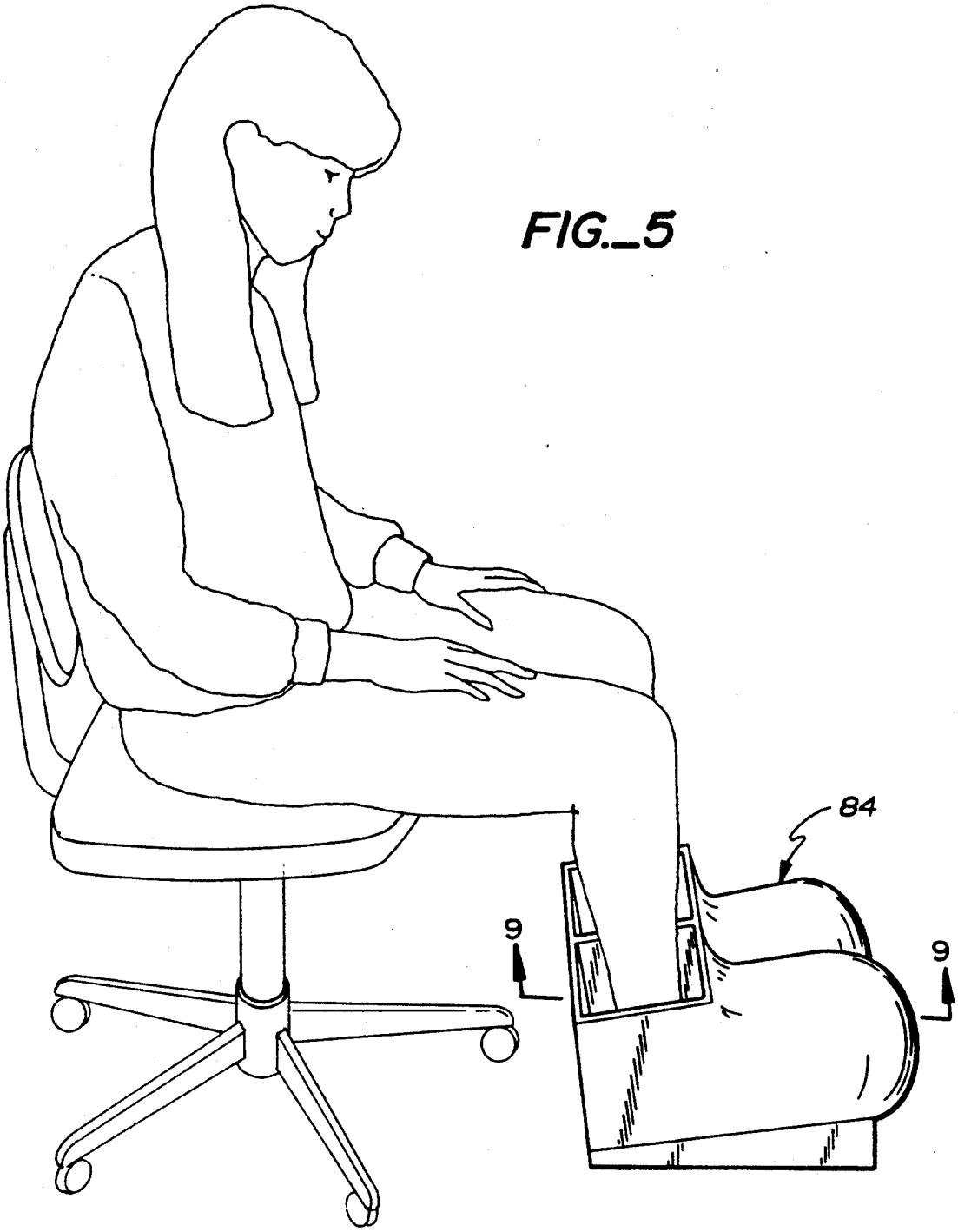
FIG. 5 shows an alternate form of cabinet module being utilized to massage a person's feet.

The module 70 and the attachment hoses 80, 81 associated therewith may be readily disconnected from cabinet 10 by means of suitable connectors 82 at the ends of the hoses. The module and hoses 80, 81 may then be attached to another form of cabinet which is in modular form and identified in FIGS. 5 and 9 by reference numeral 84. This form of cabinet is utilized for the massage or treatment of feet in much the same manner that the cabinet 10 was utilized to massage or therapeutically treat hands. With regard to the practice of reflexology, such discipline encompasses pressure points on the feet as well as the hands and such points are well known in the prior art. For example, The Foot Book by Devaki Berkson, published by Barnes and Noble Books, identifies such reflexology points or locations.

As was the case with respect to cabinet 10, walls of cabinet 84, including back wall 86, bottom wall 88, and top wall 90 define a plenum. Furthermore, it is to be understood that the plenum is preferably defined in part by a divider wall (not shown) similar to divider wall 36 of cabinet 10. The side walls of the cabinet 84 also define part of the plenum.

As was the case with cabinet 10, the plenum of cabinet 84 is divided into separate plenum chambers such as plenum chamber 92 of the back wall and plenum chamber 94 which extends along the periphery of the top, front, and bottom of the cabinet. The module 70 is connected through attachment hoses 80, 81 and through internal tubing members such as tubing member 96 operatively associated with plenum chamber 94 to the desired plenum chambers. Water or other pressurized fluid will enter the interior of the cabinet 84 through apertures formed in the cabinet walls at the desired locations therein and form fluid jets impacting against the foot as indicated by the arrows in FIG. 9.

Fluid will exit the interior of cabinet 84 through a drain 96 and will proceed to the inlet of pump 72 in module 70 for recirculation purposes.

Positioning means is provided for properly positioning the user's feet within the cabinet 84. More particularly, in the arrangement illustrated, the positioning means includes two foot supports 98, 100 which elevate the foot from the bottom wall 88, the supports 98, 100 having inclined foot engaging surfaces so that the feet may be maintained in a comfortably tilted position.

Figure 8:
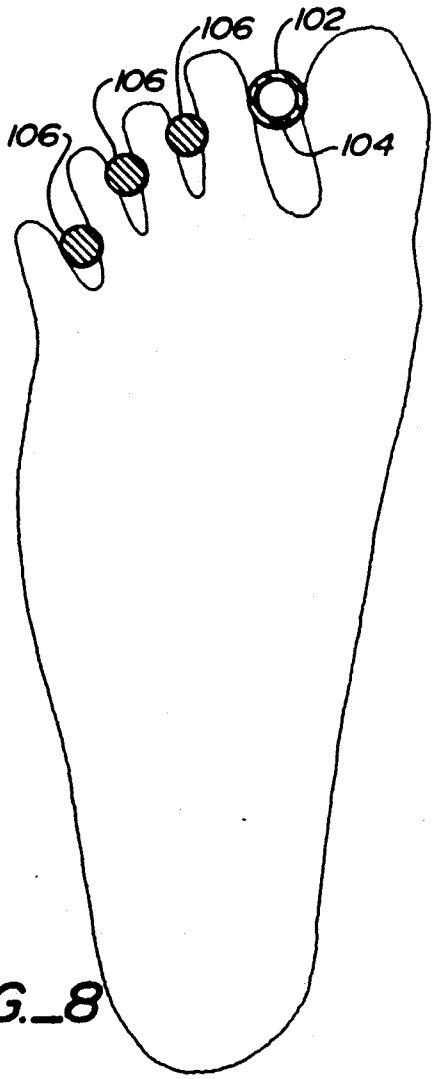
FIGS. 6–8 are schematic representations of a human foot, with FIGS. 7 and 8 showing separators utilized to separate the toes when practicing the teachings of the present invention.
Figure 7:
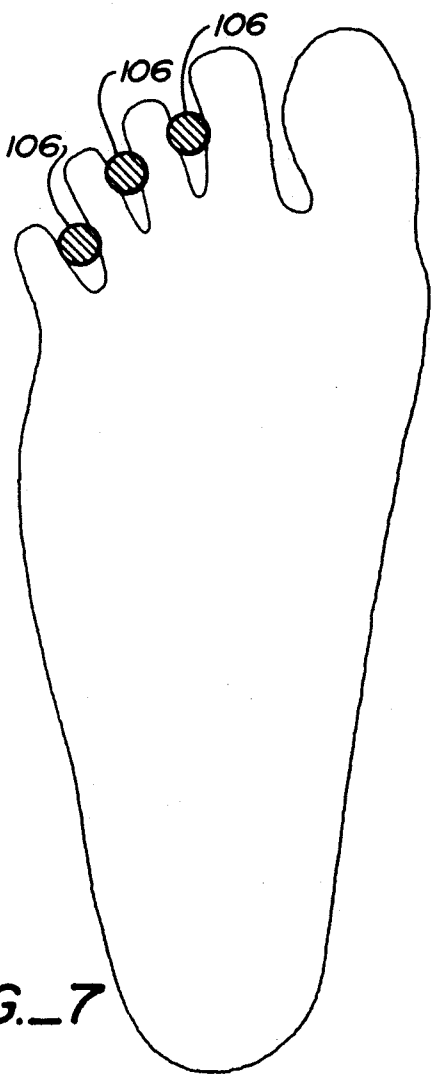
Figure 6:
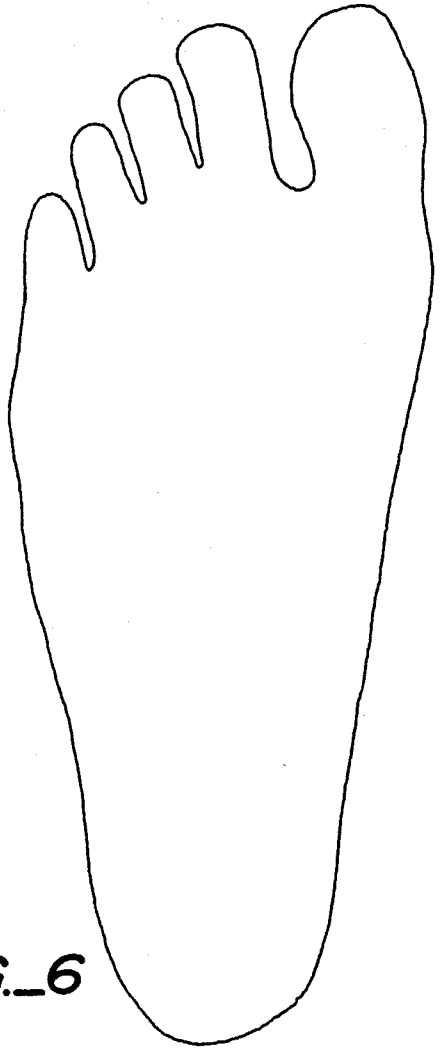

A conduit 102 extends between the cabinet top and bottom walls and has a passageway communicating with the plenum chamber 94. Conduit 102 is positioned between the user's big toe and adjacent toe as shown in FIG. 8 to properly position the user's foot within the cabinet. Pressurized fluid exits the passageway through one or more apertures 104 directed toward the foot.

It is desirable that all of the toes of the user's feet be splayed or separated so that pressurized fluid may impact therebetween. For this purpose, dowels 106 are positioned between the toes other than the big toe prior to insertion of the foot within the interior of cabinet 84.

Figure 9:
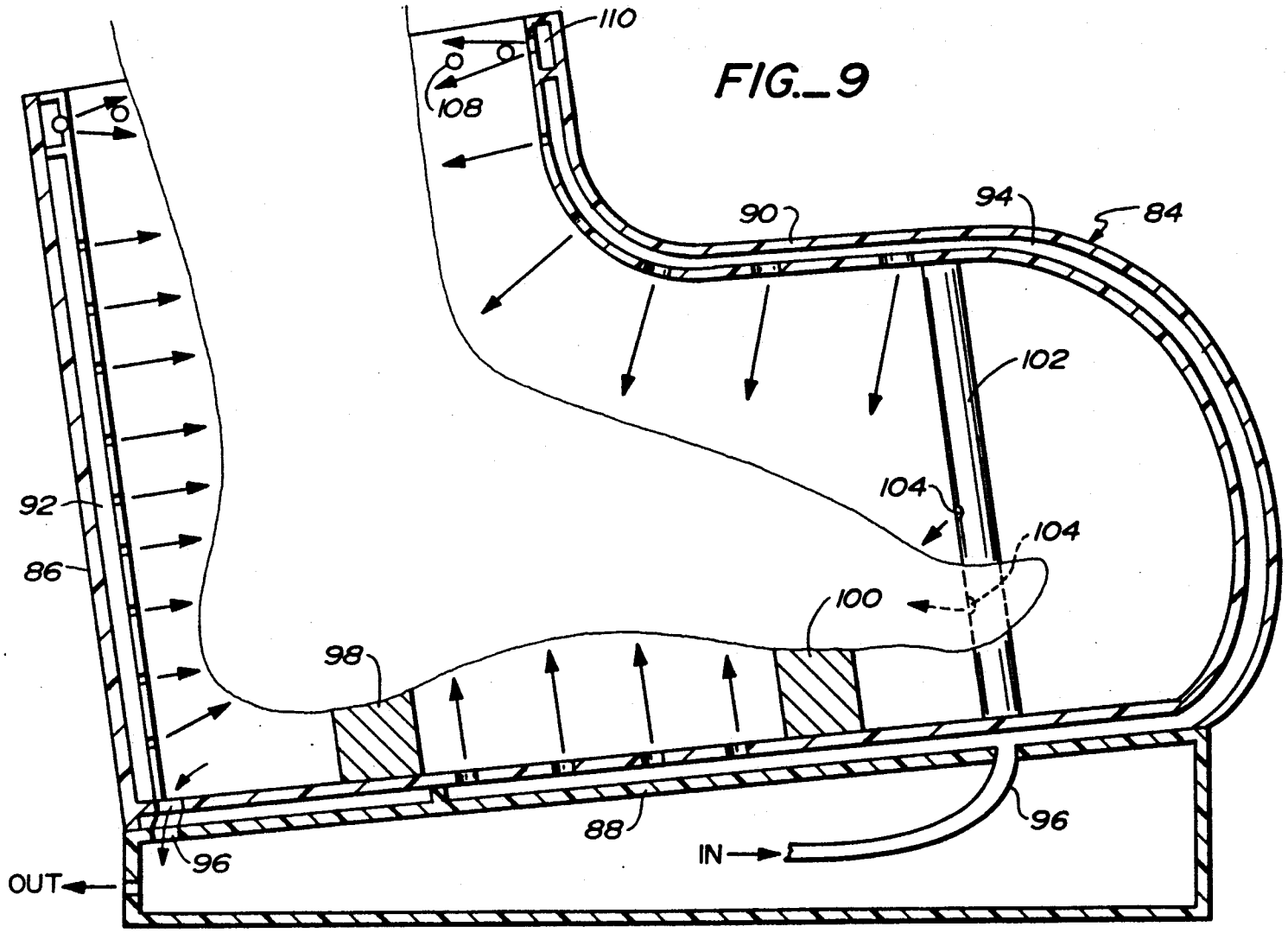
FIG. 9 is an enlarged, cross-sectional view taken along the line 9–9 of FIG. 5.

Cabinet 84 also differs from Cabinet 10 in that it utilizes an air curtain, rather than a sleeve, to prevent pressurized fluid from exiting the cabinet interior. As shown in FIG. 9, one means to accomplish this is dispose a ring of spaced air outlets 108 about the foot opening of the cabinet to direct compressed air from an air curtain plenum 110 in the direction of the user's leg.

Any suitable material may be utilized to form the modular components of the apparatus. For example, molded plastic has been found to be a suitable material for construction of cabinets 10, 84. Other modifications can be made within the scope of the present invention. For example, the module 70 may incorporate a suitable mechanism to impart a pulsing action to the fluid jets.

What is claimed is:

1. Apparatus for applying fluid pressure at spaced predetermined locations on at least one human extremity, said apparatus comprising, in combination:

cabinet means defining an interior for receiving said at least one human extremity, said cabinet means being of multi-wall construction with said walls defining a plenum and a plurality of apertures providing fluid-flow communication between said plenum and said interior, said cabinet means including side walls and a divider wall positioned between said side walls, said side walls and said divider wall each including a pair of spaced wall panels defining a plurality of separate plenum chambers spaced from each other, said divider wall dividing said interior into two separate interior portions communicating with different plenum chambers, with each said interior portion sized to accommodate a human extremity, at least one wall panel of each of said side walls and said divider wall having a plurality of apertures providing the communication between said interior portions and said plenum chambers;

pressurized fluid supply means for supplying pressurized fluid to said plenum whereby said pressurized fluid will exit at least some of said apertures and be directed in the form of discrete jets into said interior;

positioning means in operative association with said cabinet means and engageable by said at least one human extremity to position said at least one human extremity at a predetermined location within said interior spaced from said apertures whereby said jets will be directed at said spaced, predetermined locations on said at least one human extremity; and means operatively associated with said cabinet means and said pressurized fluid supply means to direct said pressurized fluid to preselected separate plenum chambers and through the apertures in said wall panels to said separate interior portions.

2. The apparatus according to claim 1 wherein said cabinet means comprises separate first and second cabinet modules, one of said cabinet modules for accommodating at least one human foot and the other of said cabinet modules for accommodating at least one human hand, said apparatus additionally comprising connector means for selectively alternatively operatively connecting said pressurized fluid supply means to said cabinet modules.

3. The apparatus according to claim 1 wherein said positioning means at least partially comprises a plurality of conduits extending between walls of said cabinet means, said conduits being located and sized for placement between the fingers of a human hand, said conduits defining fluid flow passageways in communication with said plenum chambers, said conduits additionally defining apertures communicating with said fluid flow passageways for directing fluid jets toward said human hand.

4. The apparatus according to claim 1 wherein said fluid is a liquid, said cabinet means defining a drain for removing liquid from said cabinet means, and said apparatus additionally comprising means for recirculating liquid passing through said drain back to said pressurized fluid supply means.

5. The apparatus according to claim 1 wherein both of the wall panels of said divider wall define apertures for directing fluid jets toward an opposed side wall.

6. The apparatus according to claim 5 wherein the wall panels of said side walls comprise an inner panel and an outer panel, said outer panels being fluid impermeable and said inner panels defining apertures for directing fluid jets toward said divider wall.

7. The apparatus according to claim 1 wherein said at least one human extremity is a foot and wherein said cabinet means has a bottom wall, said positioning means including at least one foot support defining an inclined foot engaging surface positioned above said bottom wall.

8. The apparatus according to claim 7 additionally comprising toe separator means positionable between the toes of said human foot to maintain separation between said toes.

9. The apparatus according to claim 7 wherein said positioning means further includes a conduit defining a passageway in communication with said plenum, said conduit further defining at least one aperture communicating with said passageway for directing fluid jets toward said foot.

10. The apparatus according to claim 1 wherein said cabinet means defines an opening for the ingress and egress of a human extremity into said interior, said apparatus additionally comprising means forming a seal between said extremity and said cabinet means.

11. The apparatus according to claim 1 wherein said pressurized fluid supply means includes means for selectively supplying either pressurized gas or pressurized liquid to said plenum.

12. The apparatus according to claim 11 wherein said pressurized fluid supply means includes a module separate from said cabinet means which houses said means for selectively supplying pressurized gas or pressurized liquid and selectively connectable hose means for transporting said pressurized gas and pressurized liquid to said cabinet means.

13. The apparatus according to claim 3 wherein said positioning means additionally comprises at least one spacer having a contact surface engageable by a human extremity to maintain said human hand out of engagement with the walls of said cabinet means.

* * * * *